US005738130A

United States Patent [19]

Thomas

[11] Patent Number: 5,738,130

[45] Date of Patent: Apr. 14, 1998

[54] VEHICLE SUPPORTED TENT

[76] Inventor: William Thomas, Utica Rte., Hobson, Mont. 59452

[21] Appl. No.: 779,369

[22] Filed: Jan. 6, 1997

[51] Int. Cl.[6] ..... E04H 15/06

[52] U.S. Cl. ..... 135/88.13; 52/88.14; 52/88.15; 52/88.16; 52/88.17

[58] Field of Search ..... 135/88.13, 88.14, 135/88.15, 88.16, 88.17; 52/DIG. 4, DIG. 13; 296/159, 164, 156

[56] References Cited

U.S. PATENT DOCUMENTS

| | | | |
|---|---|---|---|
| Re. 29,264 | 6/1977 | Woodward . | |
| 2,615,458 | 11/1952 | Jones . | |
| 2,806,478 | 9/1957 | Sherbinin . | |
| 2,938,525 | 5/1960 | MacKinlay . | |
| 3,186,419 | 6/1965 | McCarroll . | |
| 3,333,594 | 8/1967 | Moss . | |
| 3,702,617 | 11/1972 | Franzen . | |
| 3,805,872 | 4/1974 | Lorber | 52/DIG. 4 X |
| 3,863,977 | 2/1975 | Hardinge . | |
| 3,968,809 | 7/1976 | Beavers . | |
| 4,245,863 | 1/1981 | Carter | 52/DIG. 4 X |
| 4,457,553 | 7/1984 | Larkin | 135/88.14 X |
| 4,504,049 | 3/1985 | Straub . | |
| 4,867,502 | 9/1989 | Sylvester et al. . | |
| 4,877,044 | 10/1989 | Cantwell et al. | 52/DIG. 13 X |
| 5,205,086 | 4/1993 | Heim | 52/DIG. 13 X |

*Primary Examiner*—Christopher Kent
*Attorney, Agent, or Firm*—George R. McGuire

[57] ABSTRACT

A tent capable of being positioned in either a free-standing position or in supported relation to a vehicle. A top and two side fabric panels comprising a portion of the tent's skin is adapted to enshroud and become attached to a portion of the rear end of a vehicle. A plurality of magnets are sewn into the seam formed along the entire free edge of the top, vehicle covering, fabric panel, and a portion of the side panels' free edges. The magnets effectively attach the panels to the vehicle when placed in contacting relation thereto. Finger pump actuated suction cups are attached to the tent's frame and engage each of the vehicle covering, side panels. The suction cups may be stuck to the vehicle's side panels to effectively secure attachment of the side fabric panels thereto. To ensure that the top and side fabric panels are effectively sealed around the vehicle, a pair of drawstring assemblies are fixedly secured to the opposite side edges of the top, vehicle covering fabric panel. The drawstring assemblies permit the fabric panels to be pulled and maintained in tight, contacting relation to the vehicle, thereby preventing wind and other wind elements from penetrating the tent's interior.

25 Claims, 7 Drawing Sheets

VEHICLE SUPPORTED TENT

BACKGROUND OF THE INVENTION

The present invention relates generally to portable shelters, and more particularly to a tent positioned in supported relation to the rear of an automobile, such as a mini-van, conversion van or sport utility vehicle, so that the rear portion of the vehicle and the tent may form one contiguous sheltered space.

Camping has always been a popular, inexpensive vacation choice. However, pitching a tent and sleeping on the ground in a non-heated, non-lit shelter detracts some people from the activity. For these people, mobile homes and recreational vehicles (RVs) having all the conveniences of a house have been a viable alternative to pitching a tent, although the cost for such a vehicle is quite high, and may be prohibitively high for many people.

For those people desirous of having the amenities provided by a vehicle, but who choose not to spend the money for such a vehicle, a large variety of practical combinations of tent camping and RV camping have been developed. The combinations each include a tent structure adapted to be attached to, or enshroud a portion of a motor vehicle. These structures provide an individual with the economy and camping experience offered by a tent, as well as the amenities offered by a motor vehicle, such as a van. Examples of such structures are exemplified in U.S. Pat. Nos. 3,702,617 to Franzen; 3,333,594 to Moss; 3,186,419 to McCarroll; 3,968,809 to Beavers; 3,863,977 to Hardinge; among others.

With respect to such types of structures, features such as its versatility, ease of assembly, and structural rigidity are important considerations. For instance, for those campers who may be staying at a campsite for multiple nights, but who wish to drive elsewhere during the days, it is desirable to have a tent that may stand freely as well as in relation to a vehicle, thereby not requiring the entire tent to be reassembled every day (e.g., U.S. Pat. No. 2,615,458 to Jones). Additionally, for people who desire to camp in extremely harsh weather conditions, the effectiveness of the seals created between the vehicle and the tent is an important consideration, as is the rigidity of the tent structure.

Accordingly, it is a principle object of the present invention to provide a versatile tent structure that is easily secured to, and enshrouds a portion of the rear of a vehicle, preferably a sport utility vehicle.

It is an additional object of the present invention to provide a tent that may stand in either attached or detached relation to a vehicle.

It is a further object of the present invention to provide a tent that may be securely sealed to a vehicle, thereby completely protecting its occupants from inclement weather.

Other objects and advantages of the present invention will in part be obvious, and in part appear hereinafter.

SUMMARY OF THE INVENTION

In accordance with the foregoing objects and advantages, the present invention provides a tent structure adapted to effectively provide shelter while in either attached, contiguous relation to the rear end of an automobile, preferably a sport utility vehicle, or in a free standing condition. The tent is essentially conventional in that it is composed of a plurality of nylon or canvas panels stitched together and stretched between a plurality of poles which provide the structural rigidity to the tent. One side of the tent includes a zippered closure to either separate or bring together two of the panels at a position about midway between two vertically oriented poles. The zippered closure, of course, provides a doorway for egress into and out of the tent.

The portion of the tent which engulfs the rear end of the vehicle includes a plurality of magnets positioned along the terminal edge of the upper and side panels. The magnets provide a secure attachment of the tent to the vehicle. In addition, at least one finger pump actuated suction cup is attached to the tent's frame and passes through each of the side panels adapted to cover the rear end of the vehicle. The suction cups, particularly the pump actuated suction cups, provide further means for securely attaching the tent to a vehicle.

To ensure the maximum effectiveness of the magnets and suction cups, and to prohibit the weather from affecting their performance, each magnet and suction cup is covered by a portion of the fabric panels. This ensures that weather, dirt and other foreign particles do not infiltrate and diminish the usefulness of the magnets and suction cups.

A pair of adjustable drawstrings extend between the upper panel and each of the side panels which cover the vehicle's rear end. One end of each drawstring is securely stitched to the upper panel, and the pair of drawstrings extend downwardly therefrom with the strings passing over opposing sides of the pole which supports the upper portion of the side panels. After each drawstring passes over the respective pole, the free ends of the drawstring pass through a conventional cord lock which fixes the strings in position. The cord lock, which includes a button to disengage its grip on the drawstring, may then be disengaged from the drawstring and slid upwardly relative to the drawstring until the strings are taut and it abuts the pole, at which point the lock's button may be released, thereby fixing the drawstring and lock in position with respect to one another. Accordingly, the upper, vehicle covering panel of the tent may be forced downwardly over the sides of the vehicle, and thus the snugness and quality of sealing of the tent over the rear end of the vehicle, is selectively controlled via the drawstring assemblies positioned on each side of the tent.

To provide an even more secure fit of the tent over the vehicle, an elongated strip of hook and loop fastener (i.e., VELCRO®) is sewn along the leading edges of the tent's side panels. The pile portion of the VELCRO® is entirely fixed along the edge of each side panel, and the hook portion, which is positioned in adjustable, overlying relation to the pile, is stitched to each panel only along its upper edge. By only stitching the upper edge of the hook strip, it may be pulled downwardly until the side panel to which it is stitched is tightly fit to the vehicle's side panel. It may then be positioned in contacting relation to the pile strip, thereby fixing the tent's side panel in tight fitting relation to the vehicle's side panels.

To detach the tent from the vehicle, the drawstrings and VELCRO® fasteners may first be loosened, and the suction cups and magnets disengaged from the vehicle. The rear door(s) of the vehicle may then be closed and the vehicle pulled forward, away from the tent. The tent's panels which were in covered relation to the rear of the vehicle will then collapse. A pole to support one lower edge of the pitched roof may then be extended between the poles supporting one side of the front and rear portions of the tent, and then the side edges of the collapsed panels and the lower edge of the collapsed panel may be staked to the ground, thereby forming a free standing tent.

BRIEF DESCRIPTION OF THE DRAWINGS

The foregoing and other features of the invention will be more readily understood and fully appreciated from the following Detailed Description, taken in conjunction with the accompanying drawings, wherein.

DETAILED DESCRIPTION

Figure 1:
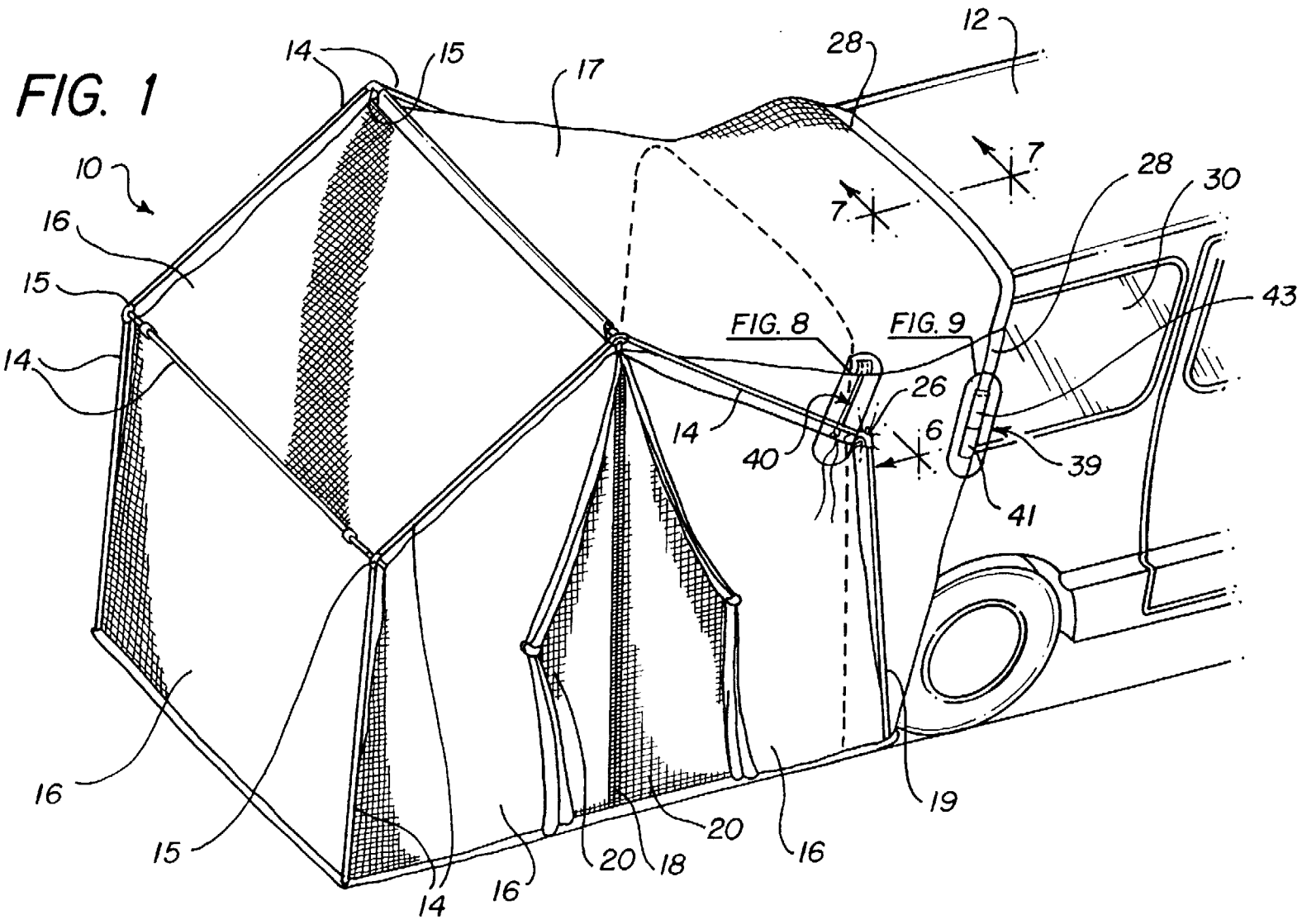
FIG. 1 is a perspective view of the present invention, showing a vehicle in supporting relation to a tent.
Figure 2:
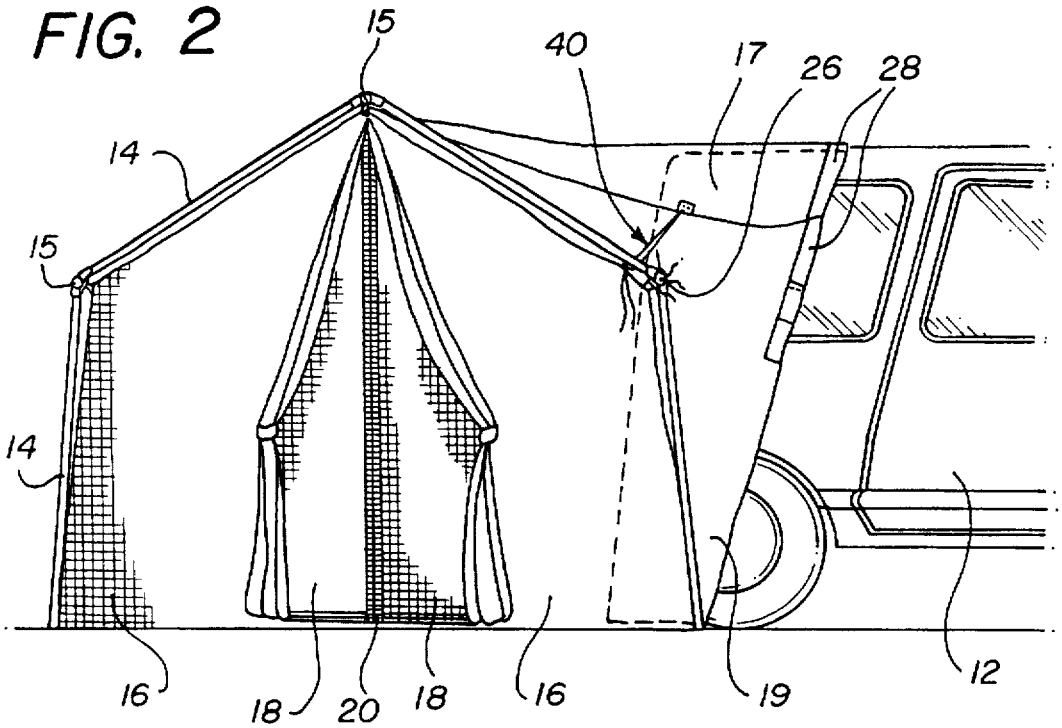
FIG. 2 is a side elevational view thereof.
Figure 3:
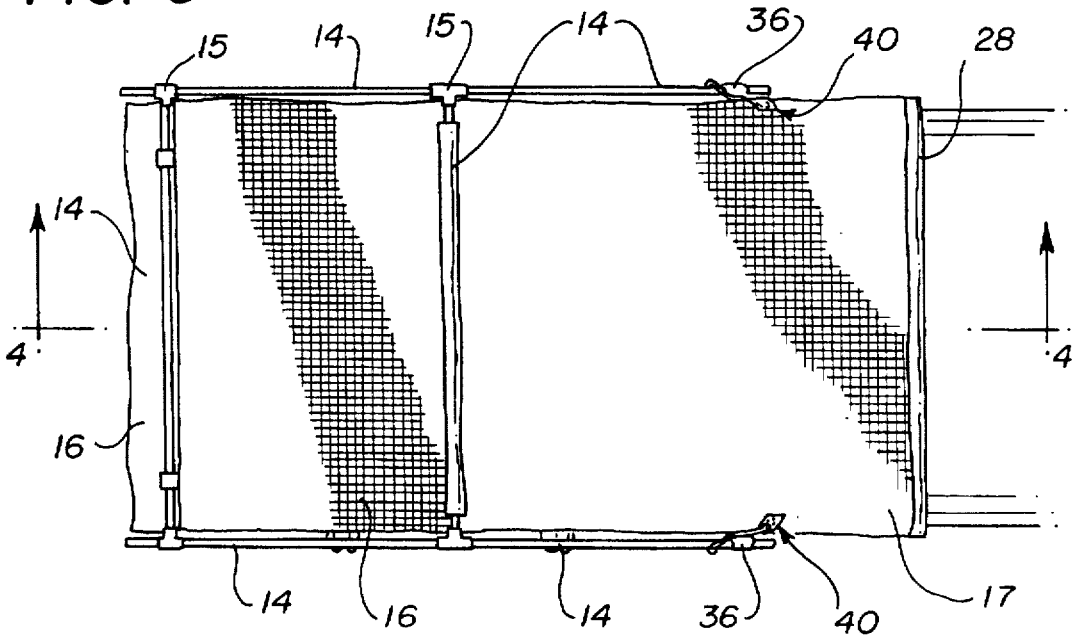
FIG. 3 is a top plan view thereof.

Referring now to the drawings, wherein like reference numerals refer to like parts throughout, there is seen in FIG. 1 a tent, denoted generally by reference numeral 10, being partially supported by a vehicle 12 and partially supported by a series of poles 14, interconnected by tees 15, which form the skeleton of the tent. Tent 10 is comprised of a plurality of fabric (i.e., nylon or canvas) panels 16 stitched together along common edges and which are stretched between and attached to poles 14, and a plurality of fabric panels 17 and 19 which are stretched, in partially covering relation, over the roof and two sides, respectively, of vehicle 12, at the rear end thereof. The front of tent 10 includes two fabric panels 16 which may be joined together or separated by a zipper 18, thereby providing closure to the tent and means for egress into and out of tent 10. A pair of mesh panels 20 are stitched along their edges to the interior of the front panels 16, and may also be separated or joined together via zipper 18. Mesh panels 20 provide means for maintaining tent 10 in a closed position to keep insects, among other things, out of the tent's interior, while simultaneously allowing fresh air to circulate through the tent.

Figure 4:
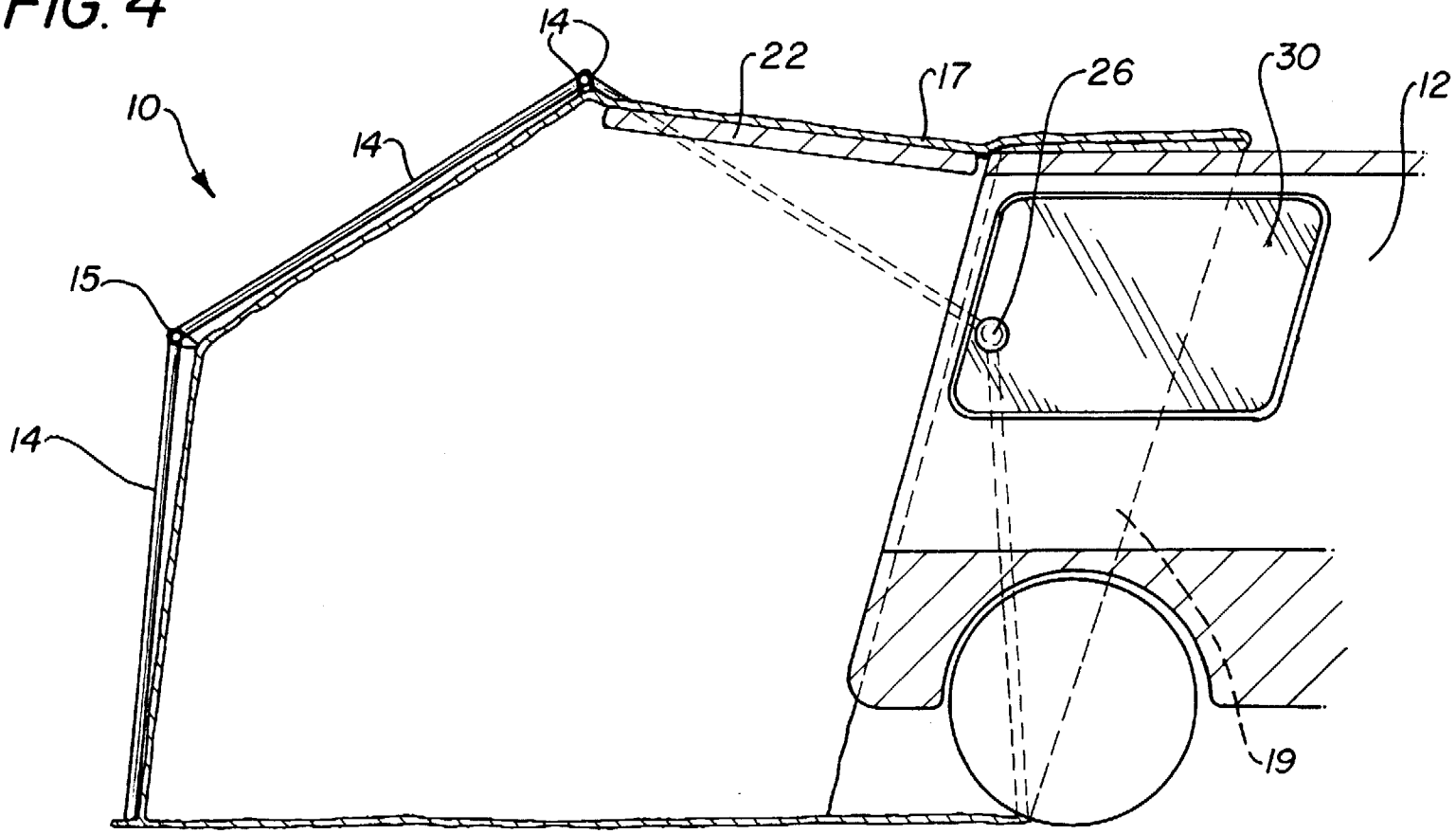
FIG. 4 is a cross-sectional view taken along section line 4—4 of FIG. 3.

Panels 17 and 19 are adapted and sized to be securely fit over the rear of vehicle 12. With particular reference to FIG. 4, it becomes apparent that tent 10 is intended to be used with a vehicle 10 having a rear door 22 that is hinged along the vehicle's roof such that the door, when open, extends in a common horizontal plane with that of the roof. It would be possible, however, to manipulate tent 10 to fit over the rear end of a vehicle having one or two side opening doors.

Panel 17 is essentially rectangular in shape and has a width greater than the width of most, if not all, sport utility type vehicles, and a length equal to about twice that of any of the other panels 16. When positioned over vehicle 12, panel 17 doubles under itself due to its length. The extraordinary length of panel 17 permits it to collapse and form an entire side wall of tent 10 when in a free standing position, as will be explained hereinafter. Panels 19 are essentially triangular in shape and have a length about half the length of panel 17, and a height at least as long as the height of a conventional sport utility type vehicle, such as vehicle 12. These dimensions permit panels 17 and 19 to engulf the rear end of vehicle 12, or any similar vehicles.

Figure 7:
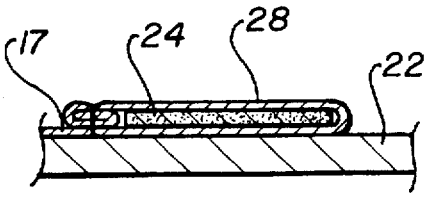
FIG. 7 is a cross-sectional view taken along section line 7—7 of FIG. 1, showing, in particular, a magnet positioned in a pocket formed along the edge of one of the tent's panels.

To ensure secure attachment between panels 17 and 19 and vehicle 12, a series of magnets 24 and suction cups 26 are incorporated into tent 10 to provide the necessary attachment means. With particular reference to FIGS. 1 and 7, a series of magnets 24 are sewn into the pockets 28 formed transversely across the entire width of panel 17, at the position where panel 17 doubles under itself, and more magnets are positioned in pockets 28 formed along a portion of the leading edge of panels 19. Pockets 28 are simply formed by a magnet 24 being placed along the panels, and then folding a portion of the panel back over itself, thereby encompassing the magnet between the two layers of fabric. The seam may then be stitched to seal pocket 28.

Figure 6:
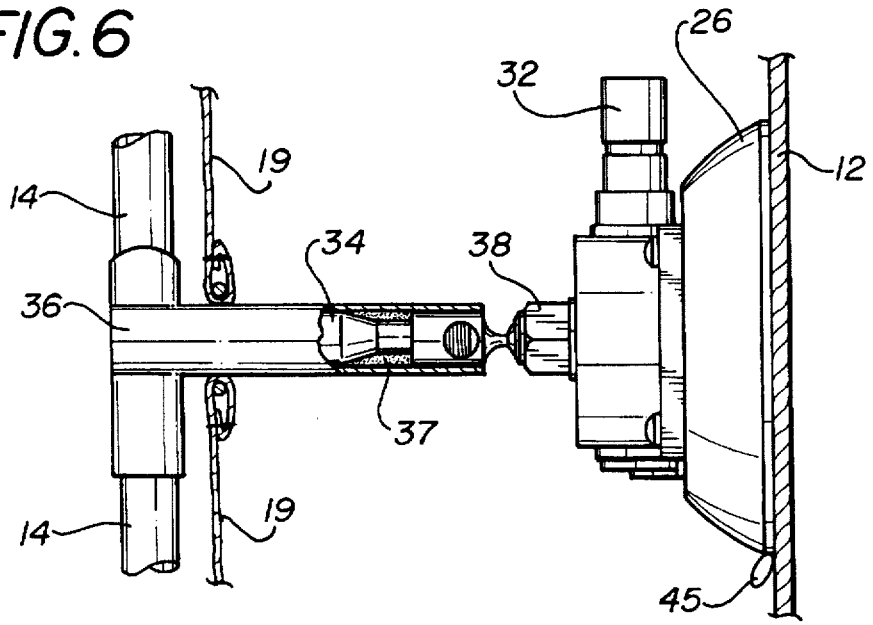
FIG. 6 is an enlarged, sectional view taken along section line 6 of FIG. 1, showing, in detail, a pump actuated suction cup.

With particular reference to FIGS. 1, 4 and 6, suction cups 26 are seen to pass through the side panels 19 such that they can be mounted, preferably, to a side window 30, or just a side panel, of vehicle 12. To provide an extra secure attachment to window 30 (or the side of vehicle 12), suction cups 26 are preferably of the pump actuated type. Each suction cup 26 includes a finger actuated pump 32 which permits air to be selectively removed from or added within the cup portion, thereby selectively creating or removing a pressure differential between the outside and inside of the cup, respectively. With pump 32, as great or as weak a pressure differential as desired can be created, thereby permitting as secure an attachment between tent 10 and vehicle 12 as desired.

With reference to FIG. 6, suction cup 26 is seen to pass through and be confined by panel 19. In addition, suction cup 26 is moveable to any desired orientation via a universal joint 34, to which it is interconnected by a bolt 38, in order to provide further versatility to cup 26. As a consequence of joint 34, it is never necessary to induce any lateral forces to cup 26 when attaching it to vehicle 12. Thus, joint 34 ensures a most effective attachment between cup 26 and vehicle 12. Joint 34 stems from, and is fixedly attached to a conventional tee 36, thereby providing the physical connection of cup 26 to tent 10. To fixedly attach joint 34 to tee 36, epoxy 37 is injected into the space (shown in cross-section in FIG. 6) existing between the tee and joint. Once epoxy 37 hardens, joint 34 is fixedly connected to tee 36.

Figure 8:
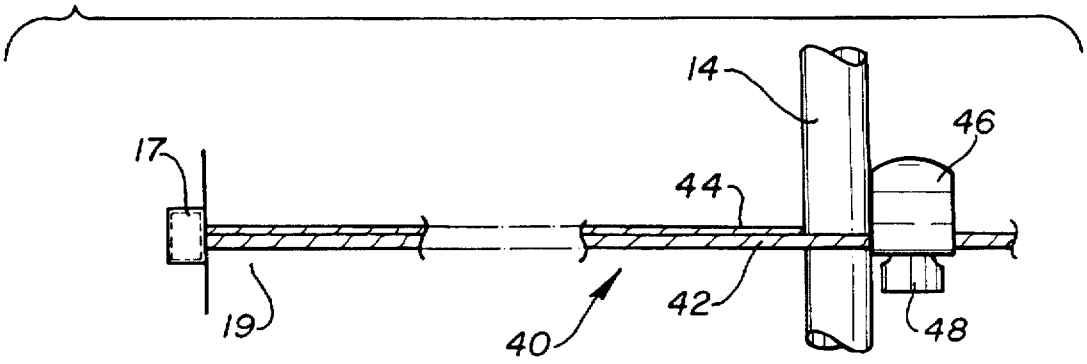
FIG. 8 is an enlarged view of the drawstring assembly circled on FIG. 1.

To effect a secure seal between tent 10 and vehicle 12, a drawstring assembly, denoted generally 40, is securely attached to the opposite side edges of panel 17 and operably attached to a pole 14 positioned adjacent each panel 19. With reference to FIGS. 1 and 8, each drawstring assembly 40 includes two strings 42, 44 both having first and second opposite ends. The first ends of strings 42, 44 are sewn onto a side edge of panel 17, adjacent panel 19, thereby fixedly attaching them thereto. Strings 42, 44 extend from their first ends across panel 19 with string 42 passing over one side of pole 14 and string 44 passing over the other side of the same pole 14. After passing around pole 14, the second ends of strings 42, 44 are passed through a conventional cord lock 46 which permits a string to be passed therethrough, but prevents the string from being removed therefrom unless the finger actuated release 48 is depressed, thereby causing cord lock 46 to release its grip on the string. Strings 42, 44 should then be pulled until they are entirely taut and cord lock 48 may be slid up strings 42, 44 until it is positioned in abutting relation to pole 14. Following this procedure will ensure that panels 17 and 19 will be securely sealed over the rear end of vehicle 12, and wind and other weather elements will be prevented from penetrating the tent's interior.

To further secure the seal between tent 10 and vehicle 12, an elongated-strip of VELCRO® fastener, denoted generally by reference numeral 39, is sewn along the leading edges of side panels 19. The pile portion 41 of VELCRO® fastener 39 is entirely secured to the leading edge of each side panel 19, and the hook portion 43, which is positioned in adjustable, overlying relation to pile 41, is stitched to panels 19 only along its upper edge (which is co-linear with the upper edge of pile 41). By only stitching hook portion 43 along its upper edge, it may be pulled downwardly until the side panel 19 to which it is stitched is tightly fit to the vehicle's side panels. Hook portion 43 may then be positioned in contacting relation to pile 41, thereby fixing panels 19 in tight fitting relation to the vehicle's side panels.

Figure 5:
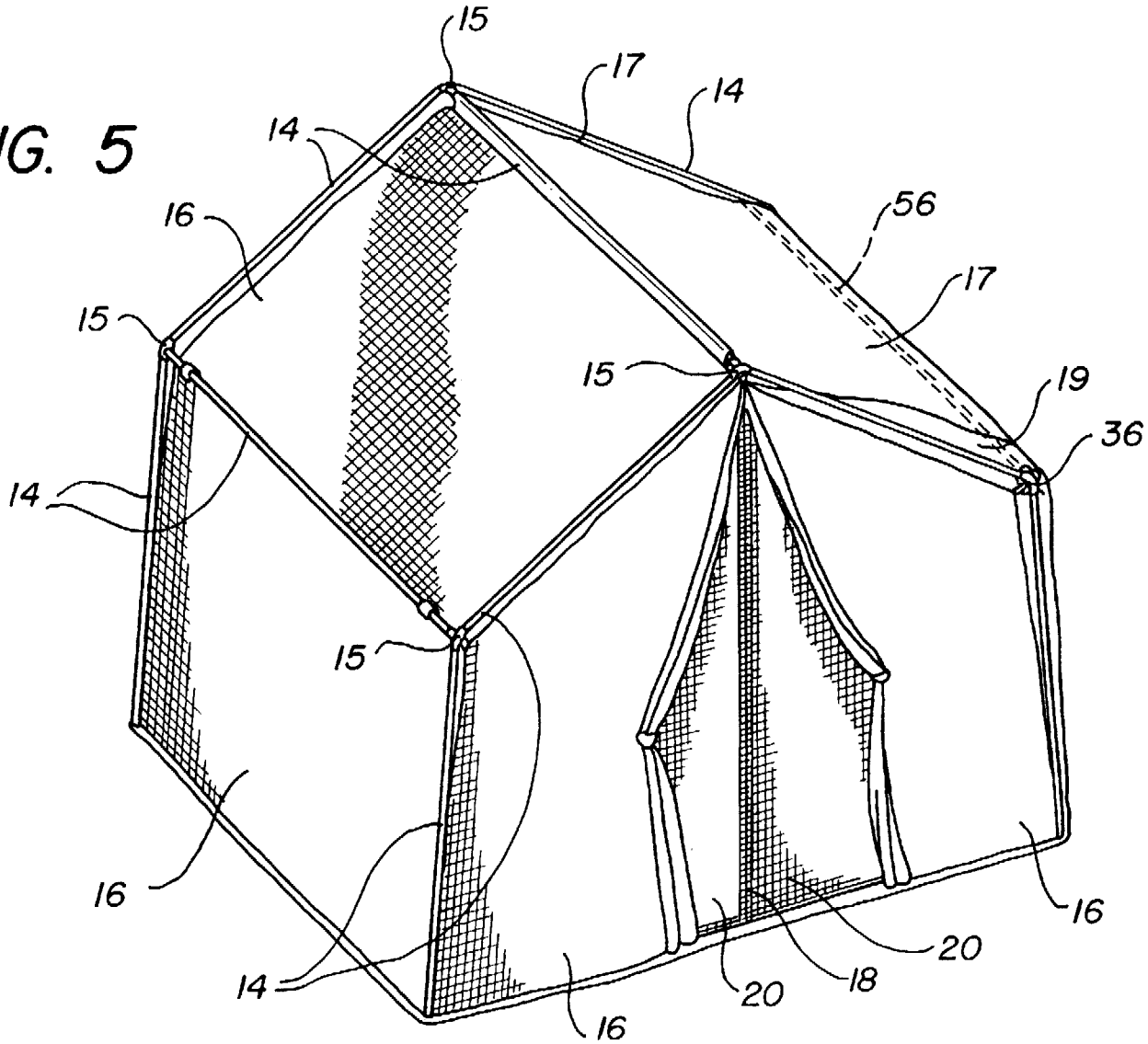
FIG. 5 is a perspective view of the tent in a free standing position.

Although tent 10 can be used in combination with vehicle 12, it may also be used and left in a free-standing position, as is shown in FIG. 5. To detach tent 10 from the rear of vehicle 12, drawstring assemblies 40 would first be loosened by depressing release 48 and sliding cord lock 48 down towards the second ends of string 42, 44, and VELCRO® fasteners loosened by detaching hook portion 43 from pile 41. The vacuum in suction cups 26 may then be released by lifting the edge of cup 26 at the tab 45 provided at the cup's edge, thereby effecting detachment of cups 26 from vehicle 12. Finally, magnets 24 can be manually pulled away from vehicle 12, thus removing the final means for maintaining tent 10 in attached relation to vehicle 12. Vehicle 12 may then be pulled forward a short distance, with panels 17 and 19 being left to collapse.

Figure 10:
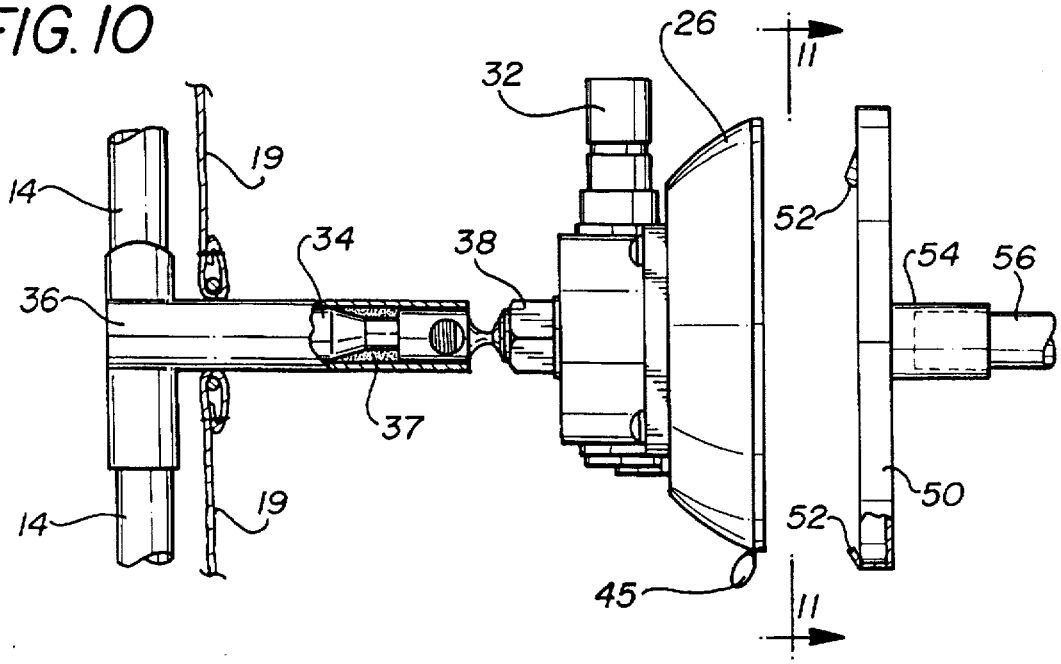
FIG. 10 is a side elevational view of the suction cup shown in FIG. 6 further showing a pole mounting adapter exploded from the suction cup.
Figure 11:
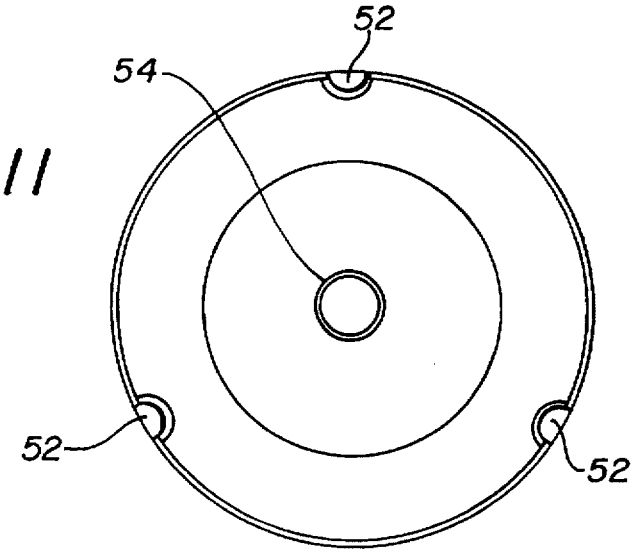
FIG. 11 is a rear plan view of the pole mounting adapter that connects to the suction cup.
Figure 9:
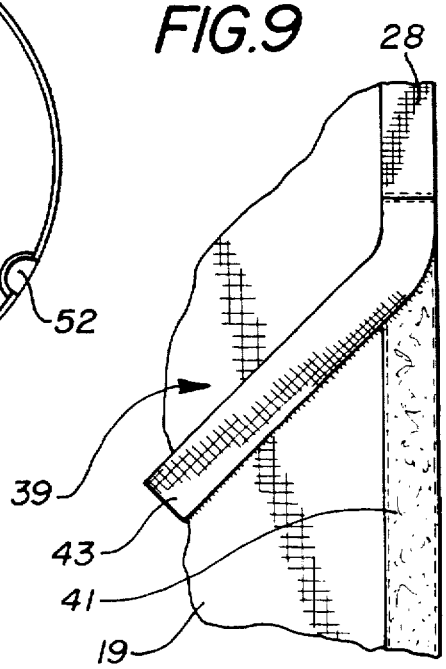
FIG. 9 is an enlarged, front elevational view of the VELCRO® sealing assembly.
Figure 12:
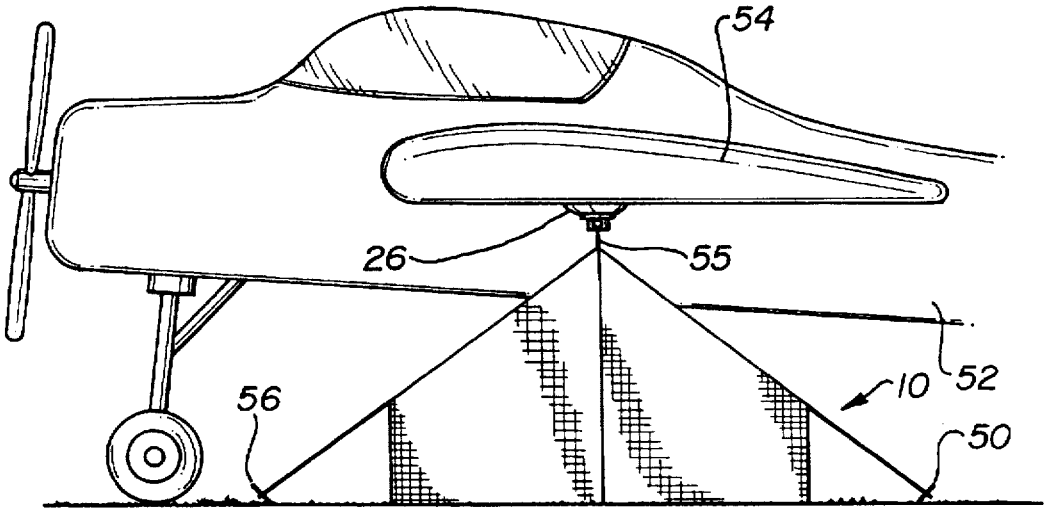
Figure 13:
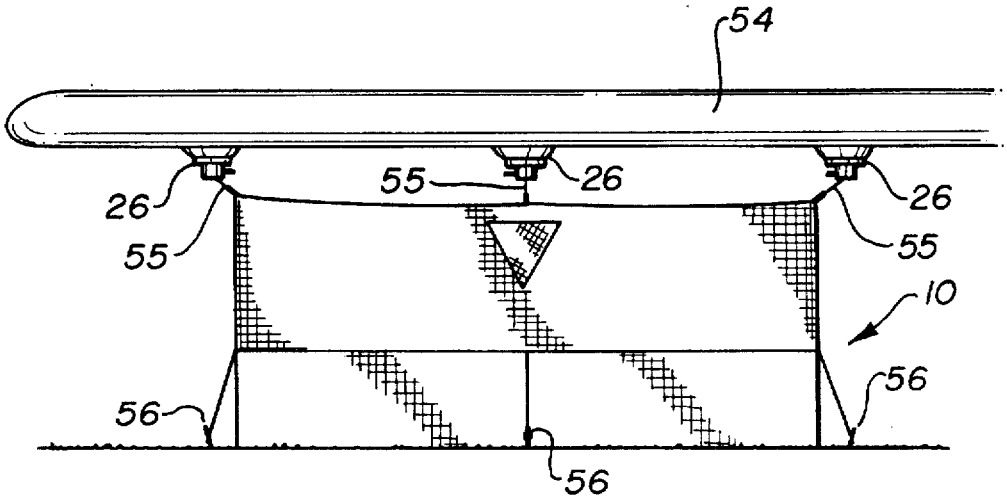

With particular reference to FIGS. 10–11, after panels 17 and 19 have collapsed, a pole mounting adapter 50 may be securely attached over the ends of each suction cup 26. Adapter 50 is disk shaped with a diameter essentially the same as the diameter of cup 26, and includes a plurality of circumferentially spaced, resilient ears 52 integrally attached to a first side thereof. Ears 52 are adapted to snappingly engage cups 26, thereby securely attaching each adapter 50 to a cup 26. Adapter 50 also includes a tube 54 integrally extending perpendicularly outwardly from the center of a second side thereof. Tube 54 is adapted to cooperatively receive a conventional tent pole 56 therein. Accordingly, after an adapter 50 is securely attached to each cup 26, and a pole 56 is positioned in extending relation between the two adapters 50, panels 17 and 19 may be draped over pole 56 and staked to the ground, thereby forming a free standing, fully enclosed tent.

What is claimed is:

1. A tent having a frame, roof, and walls, said tent for use in combination with a vehicle having a roof, first and second side panels, a rear end and at least one door hingedly attached to said rear end, said tent comprising:

a) a plurality of poles adapted to be interconnected to one another for forming said frame of said tent;

b) a plurality of first fabric panels adapted to be stretched between and attached to said poles for forming some of said walls and a portion of said roof of said tent;

c) at least one second fabric panel attached to at least one of said first fabric panels and portions of which are adapted to be positioned in at least partially covering relation to said roof and said first and second side panels of said vehicle;

d) magnetic attachment means for maintaining at least said second fabric panel in attached relation to said roof and side panels of said vehicle; and e) pressurized attachment means for maintaining said second fabric panel in attached relation to said side panels of said vehicle.

2. The tent according to claim 1 wherein a pocket is formed transversely across the entire width of said second fabric panel.

3. The tent according to claim 2 wherein said magnetic attachment means includes at least one magnet positioned in said pocket, said magnet will magnetically attach to said vehicle when positioned in contacting relation thereto.

4. The tent according to claim 1 wherein said pressurized attachment means includes at least one suction cup connected to said tent frame, each of said suction cups being adapted for secure placement on said vehicle's side panels.

5. The tent according to claim 4 wherein each of said suction cups include a finger actuated pump operably attached thereto, said pump permitting air to be selectively removed from said suction cup when mounted to one of said vehicle's side panels, whereby a pressure differential may be created and selectively controlled between said cup and the atmosphere.

6. The tent according to claim 4 wherein each of said at least one suction cups is attached to said tent frame by a universal joint, whereby said suction cups may be oriented in a plurality of positions with respect to said tent.

7. The tent according to claim 4 and further comprising means for assembling said tent into a free standing position.

8. The tent according to claim 7 wherein said assembling means includes a disk shaped pole mounting adapter having:

a) means for releasably attaching to said suction cup;

b) pole receiving means attached thereto; and c) first and second opposing planar surfaces.

9. The tent according to claim 8 wherein said means for releasably attaching said adapter to said suction cups includes at least two resilient ears integrally attached to said first surface, and being circumferentially spaced about the periphery of said adapter, said ears adapted for snappingly engaging said suction cup.

10. The tent according to claim 8 wherein said pole receiving means includes a tube integrally attached to and extending perpendicularly outwardly from said second surface of said adapter, said tube being sized to operably receive a pole therein.

11. The tent according to claim 1 and further including first means for sealing said tent to said vehicle.

12. The tent according to claim 11 wherein said first means for sealing includes at least one drawstring assembly securely attached to said second fabric panel adjacent to opposite side edges of said second panel.

13. The tent according to claim 12 wherein each of said drawstring assemblies includes:

a) at least two sets of first and second drawstrings having first and second opposite ends, said first ends being fixedly attached to said second fabric panel adjacent to said vehicle's roof and first and second side panels;

b) said first drawstring extending downwardly from said second fabric panel and passing over one side of one of said poles;

c) said second drawstring extending downwardly from said second fabric panel, in essentially parallel relation to said first drawstring, said second drawstring passing under the opposite side of said pole that said first drawstring passed over; and d) a cord lock through which said second ends of said first and second drawstrings pass, said cord lock including a release button for releasing said cord lock from said first and second drawstrings, whereby pulling said first and second drawstrings through said cord lock until they are taut, and positioning said cord lock in abutting relation to said pole around which said first and second drawstrings pass, said drawstring assembly will effectively seal an attachment between said tent and said vehicle to prevent wind and other weather elements from penetrating the tent's interior.

14. The tent according to claim 1 and further including second means for sealing said tent to said vehicle.

15. The tent according to claim 14 wherein said second means for sealing includes a hook and pile assembly comprising:

a) an elongated strip of pile fabric fixedly attached in vertically extending relation to a portion of said at least one second fabric panel that lies in partially covering relation to one of said side panels of said vehicle; and b) an elongated strip of hook fabric having an upper edge attached to the portion of said at least one second fabric panel that lies in partially covering relation to said side panels of said vehicle, said hook fabric being positioned in adjustable, overlying relation to said pile fabric, whereby manually pulling on said hook fabric will effect pulling of said second fabric panel and placement of said hook fabric in contacting, overlying relation to said pile fabric will statically fix the position of said second fabric panel.

16. The tent according to claim 15 wherein one hook and pile assembly is attached to each side of said at least one second fabric panel that are in partially covering relation to said first and second side panels of said vehicle.

17. A tent having a frame, roof, and walls, said tent for use in combination with a vehicle having a roof, side panels, a rear end and at least one door hingedly attached to said rear end, said tent comprising:

a) a plurality of poles adapted to be interconnected to one another for forming said frame of said tent;

b) a plurality of first fabric panels adapted to be stretched between and attached to said poles for forming some of said walls and a portion of said roof of said tent;

c) at least one second fabric panel attached to at least one of said first fabric panels and portions of which are adapted to be positioned in at least partially covering relation to said roof and said side panels of said vehicle;

d) first means for attaching said second fabric panel to said vehicle;

e) first means for sealing said second fabric panel to said vehicle; and f) second means for sealing said second fabric panel to said vehicle.

18. The tent according to claim 17 wherein said first means for attaching includes at least one suction cup connected to said tent frame, each of said suction cups being adapted for secure placement on said vehicle's side panels.

19. The tent according to claim 17 and further comprising second means for attaching said second panel to said vehicle.

20. The tent according to claim 19 wherein a pocket is formed transversely across the entire width of said second fabric panel.

21. The tent according to claim 20 wherein said second means for attaching includes at least one magnet positioned in said pocket, said magnet will magnetically attach to said vehicle when positioned in contacting relation thereto.

22. The tent according to claim 17 wherein said first means for sealing includes at least one drawstring assembly securely attached to said second fabric panel adjacent to opposite side edges of said second panel.

23. The tent according to claim 22 wherein each of said drawstring assemblies includes:

a) first and second drawstrings having first and second opposite ends, said first ends being fixedly attached to said second fabric panel adjacent to one of said second panel's side edges;

b) said first drawstring extending downwardly from said second fabric panel and passing over one side of one of said poles;

c) said second drawstring extending downwardly from said second fabric panel, in essentially parallel relation to said first drawstring, said second drawstring passing under the opposite side of said pole that said first drawstring passed over; and d) a cord lock through which said second ends of said first and second drawstrings pass, said cord lock including a release button for releasing said cord lock from said first and second drawstrings, whereby pulling said first and second drawstrings through said cord lock until they are taut, and positioning said cord lock in abutting relation to said pole around which said first and second drawstrings pass, said drawstring assembly will effectively seal an attachment between said tent and said vehicle to prevent wind and other weather elements from penetrating the tent's interior.

24. The tent according to claim 17 wherein said second sealing means includes a hook and pile assembly comprising:

a) an elongated strip of pile fabric fixedly attached in vertically extending relation to a portion of said at least one second fabric panel that lies in partially covering relation to said side panels of said vehicle; and b) an elongated strip of hook fabric having an upper edge attached to the portion of said at least one second fabric panel that lies in partially covering relation to said side panels of said vehicle, said hook fabric being positioned in adjustable, overlying relation to said pile fabric, whereby manually pulling on said hook fabric will effect pulling of said second fabric panel and placement of said hook fabric in contacting, overlying relation to said pile fabric will statically fix the position of said second fabric panel.

25. The tent according to claim 24 wherein one hook and pile assembly is attached to each side of said at least one second fabric panel that are in partially covering relation to said side panels of said vehicle.

* * * * *